US006860529B2

(12) United States Patent
Chong et al.

(10) Patent No.: US 6,860,529 B2
(45) Date of Patent: Mar. 1, 2005

(54) PUSH BUTTON WITH LATCH KICK-OFF

(75) Inventors: Gerald B. Chong, Rowland Heights, CA (US); Gary Bergen, Yorba Linda, CA (US)

(73) Assignee: Newfrey LLC, Newark, DE (US)

( * ) Notice: Subject to any disclaimer, the term of this patent is extended or adjusted under 35 U.S.C. 154(b) by 0 days.

(21) Appl. No.: 10/284,611

(22) Filed: Oct. 30, 2002

(65) Prior Publication Data

US 2003/0107223 A1 Jun. 12, 2003

Related U.S. Application Data

(60) Provisional application No. 60/335,122, filed on Nov. 2, 2001.

(51) Int. Cl.[7] ..... E05C 1/12
(52) U.S. Cl. ..... 292/169.18; 70/467
(58) Field of Search ..... 292/169, 169.15, 292/169.18, DIG. 26; 70/467, 150

(56) References Cited

U.S. PATENT DOCUMENTS

| | | | | | |
|---|---|---|---|---|---|
| 2,263,477 | A | * | 11/1941 | Voight | 292/169 |
| 2,307,110 | A | * | 1/1943 | Chesler | 292/169 |
| 2,344,484 | A | * | 3/1944 | Ledin | 292/169 |
| 2,435,238 | A | * | 2/1948 | Schlage | 292/169 |
| 2,497,328 | A | | 2/1950 | Smith et al. | |
| 2,743,600 | A | | 5/1956 | Heyer | |
| 2,871,047 | A | | 1/1959 | North et al. | |
| 2,983,537 | A | | 5/1961 | Kubik | |
| 2,998,273 | A | | 8/1961 | Unetic | |
| 3,024,055 | A | | 3/1962 | Novarino | |
| 3,087,324 | A | | 4/1963 | Hillgren | |
| 3,314,704 | A | | 4/1967 | Jensen | |
| 3,314,708 | A | | 4/1967 | Welch | |
| 3,390,910 | A | | 7/1968 | Kuchler | |
| 3,823,585 | A | | 7/1974 | Spon | |
| 4,108,482 | A | | 8/1978 | Dietrich et al. | |
| 4,333,324 | A | | 6/1982 | Dietrich et al. | |
| 4,428,212 | A | | 1/1984 | Best et al. | |
| 4,470,279 | A | | 9/1984 | Neary et al. | |
| 4,594,864 | A | | 6/1986 | Hart | |
| 4,941,697 | A | | 7/1990 | Fan | |
| 5,004,278 | A | | 4/1991 | Kang et al. | |
| 5,141,268 | A | * | 8/1992 | Keller | 292/150 |
| 5,177,987 | A | | 1/1993 | Shen | |
| 5,259,652 | A | | 11/1993 | Adams et al. | |
| 5,284,372 | A | | 2/1994 | Lin | |
| 5,301,526 | A | | 4/1994 | Fann et al. | |
| 5,364,139 | A | | 11/1994 | Bergen et al. | |
| 5,460,417 | A | | 10/1995 | Zuckerman | |
| 5,482,335 | A | | 1/1996 | Zuckerman | |
| 5,490,700 | A | | 2/1996 | Zuckerman | |
| 5,598,726 | A | | 2/1997 | Cordle | |
| 5,636,882 | A | | 6/1997 | Hook | |
| 5,816,086 | A | | 10/1998 | Russell, IV | |
| 5,941,108 | A | | 8/1999 | Shen | |
| 6,014,878 | A | | 1/2000 | Shen | |
| 6,038,894 | A | | 3/2000 | Hu | |
| 6,101,856 | A | | 8/2000 | Pelletier et al. | |
| 6,536,248 | B1 | * | 3/2003 | Fan | 70/467 |

* cited by examiner

*Primary Examiner*—Gary Estremsky
(74) *Attorney, Agent, or Firm*—Richard J. Veltman; John D. DelPonti

(57) ABSTRACT

A tubular lockset includes a push button locking actuator with an automatic kick-off feature. A spindle assembly extends between an interior knob or lever and an exterior knob or lever. A latch assembly includes a bolt and a locking member that is movable between a locking position, where the locking member engages the spindle assembly, and an unlocking position. When the latch bolt is moved about ⅛ inch, a locking member is disengaged from the spindle assembly to unlock the lockset. The disengagement occurs independently of any movement of the interior knob or lever.

11 Claims, 11 Drawing Sheets

PUSH BUTTON WITH LATCH KICK-OFF

This application claims the benefit of Provisonal Appl. No. 60/335,122, filed Nov. 2, 2001.

The present invention relates to tubular locksets generally, and in particular to tubular locksets with a push-button mechanism for locking the lockset from the inside. More particularly, the invention relates to tubular locksets with pushbuttons that automatically unlock when the door is closed.

BACKGROUND OF THE INVENTION

Currently, tubular chassis designs are available that incorporate a turn button to actuate a privacy function. However, such turn buttons, while ADA compliant, are not operable by individuals with certain handicaps. In addition, such turn buttons must typically be rotated to the unlocked position in order to open the door from the inside. In a panic situation, such as a fire or intruder, a delay would be most inconvenient. Accordingly, a need exists for a tubular chassis design with an ADA compliant push button actuator for the privacy function as well as emergency operation without unlocking the push button.

In conventional tubular chassis designs, it is possible to be locked out of a room if the push button is actuated and the door closes. This is because the lock does not automatically unlock as the door closes. Accordingly, a need exists for a lever that includes an ADA compliant push button and an automatic latch kick-off feature that will prevent a door from inadvertently locking upon closing.

SUMMARY OF THE INVENTION

A tubular lock assembly comprises an exterior assembly, an interior assembly having a push button locking mechanism, and a spindle assembly coupled to the exterior and interior assemblies. The spindle assembly includes a longitudinally extending slot. A locking member is movable between a locking position and an unlocking position and includes a tongue configured to engage the slot while in the locking position. A bolt is disposed to engage the locking member and move the locking member from the locking position to the unlocking position in response to movement of the bolt.

According to one aspect of the invention, there are three ways to unlock the lock assembly. First, an actuator accessible from the exterior assembly is coupled to the spindle assembly and is disposed to engage the locking member and move it to the unlocking position. Second, a half round coupled to the interior assembly is disposed to move the locking member to the unlocking position in response to movement of an interior knob or lever, independent of movement of the bolt. Third, the bolt is coupled to the locking member so that movement of the bolt moves the locking member to the unlocking position independently of movement of either the interior or exterior knob or lever.

Other features and advantages will become apparent from the following description when viewed in accordance with the accompanying drawings and appended claims.

DETAILED DESCRIPTION OF THE DRAWINGS

Figure 1:
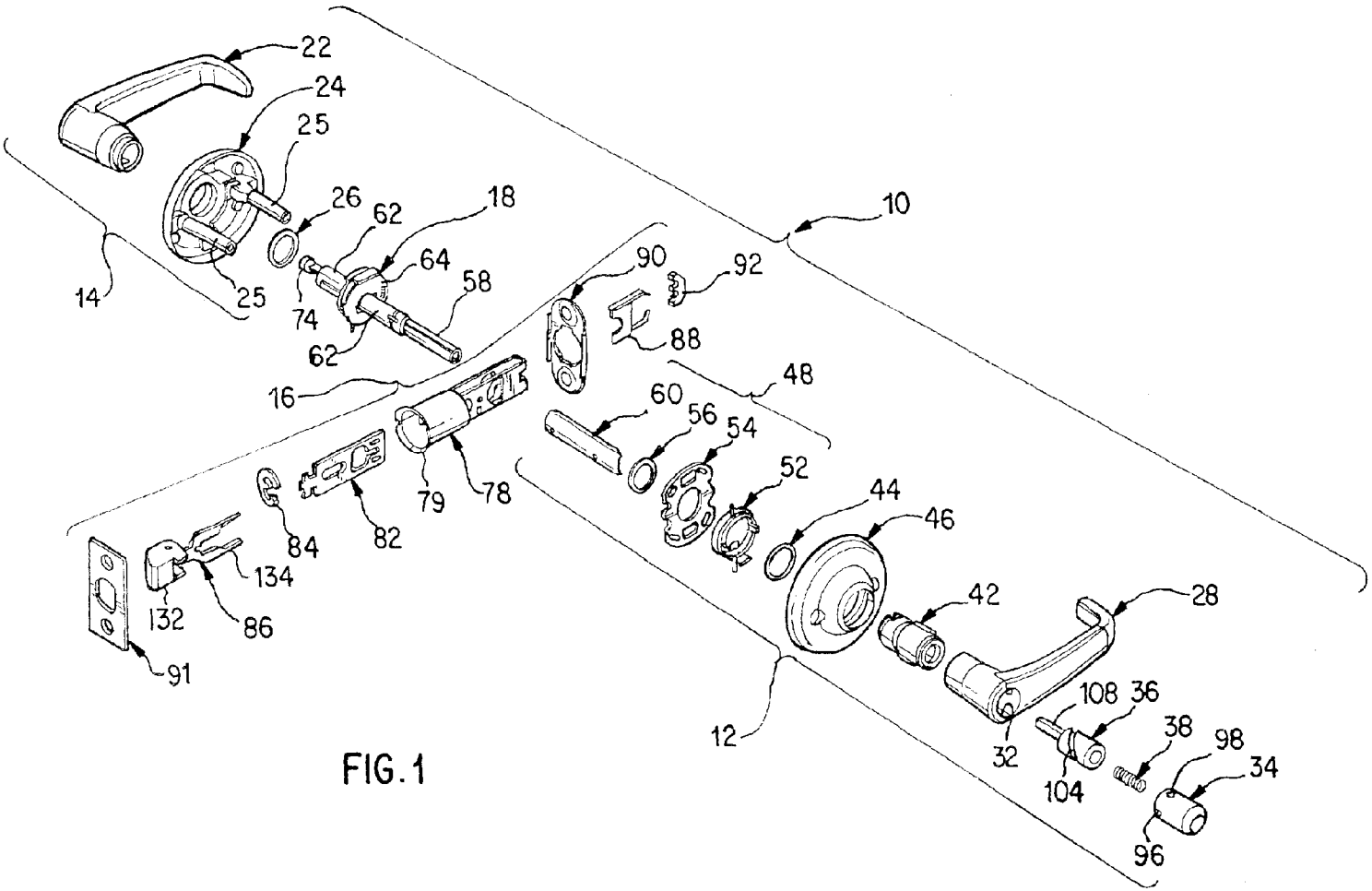
FIG. 1 is an exploded perspective view of a lockset embodying the present invention.
Figure 2:
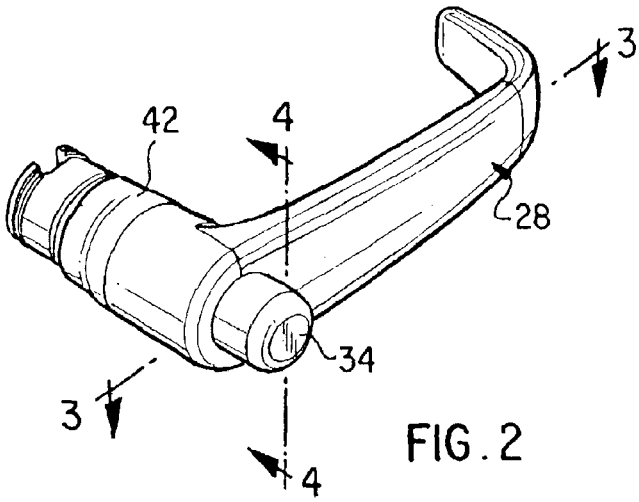
FIG. 2 is a perspective view of an interior lever for use with the present invention.
Figure 3:
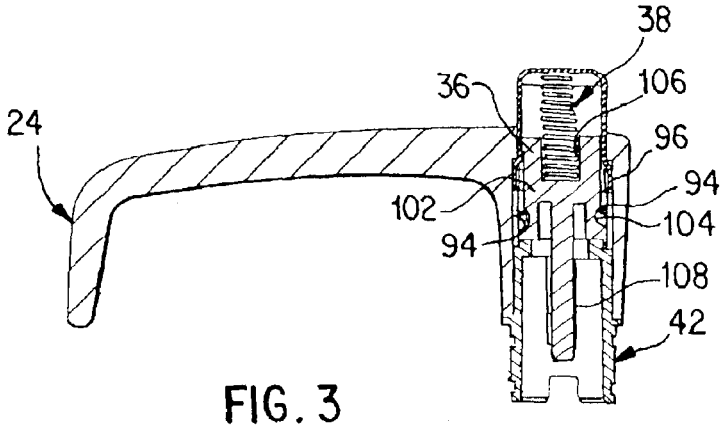
FIG. 3 is a section view taken along line 3—3 of FIG. 2.
Figure 4:
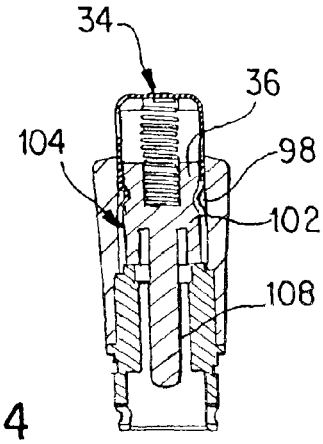
FIG. 4 is a section view taken along line 4—4 of FIG. 2.
Figure 5:
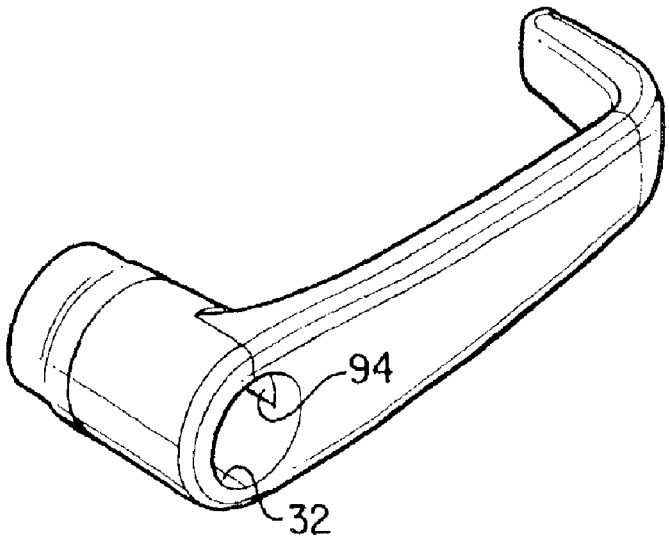
FIG. 5 is a front perspective view of the interior lever of FIG. 2 without a pushbutton sub-assembly.
Figure 6:
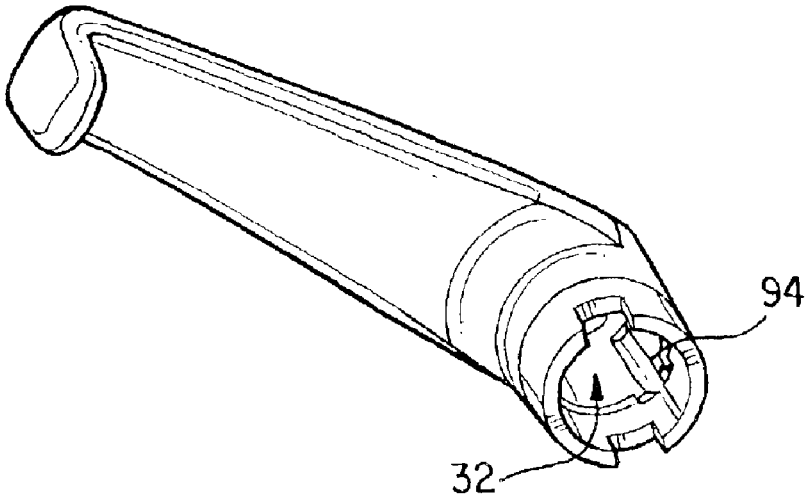
FIG. 6 is a rear perspective view of the interior lever of FIG. 5.
Figure 10:
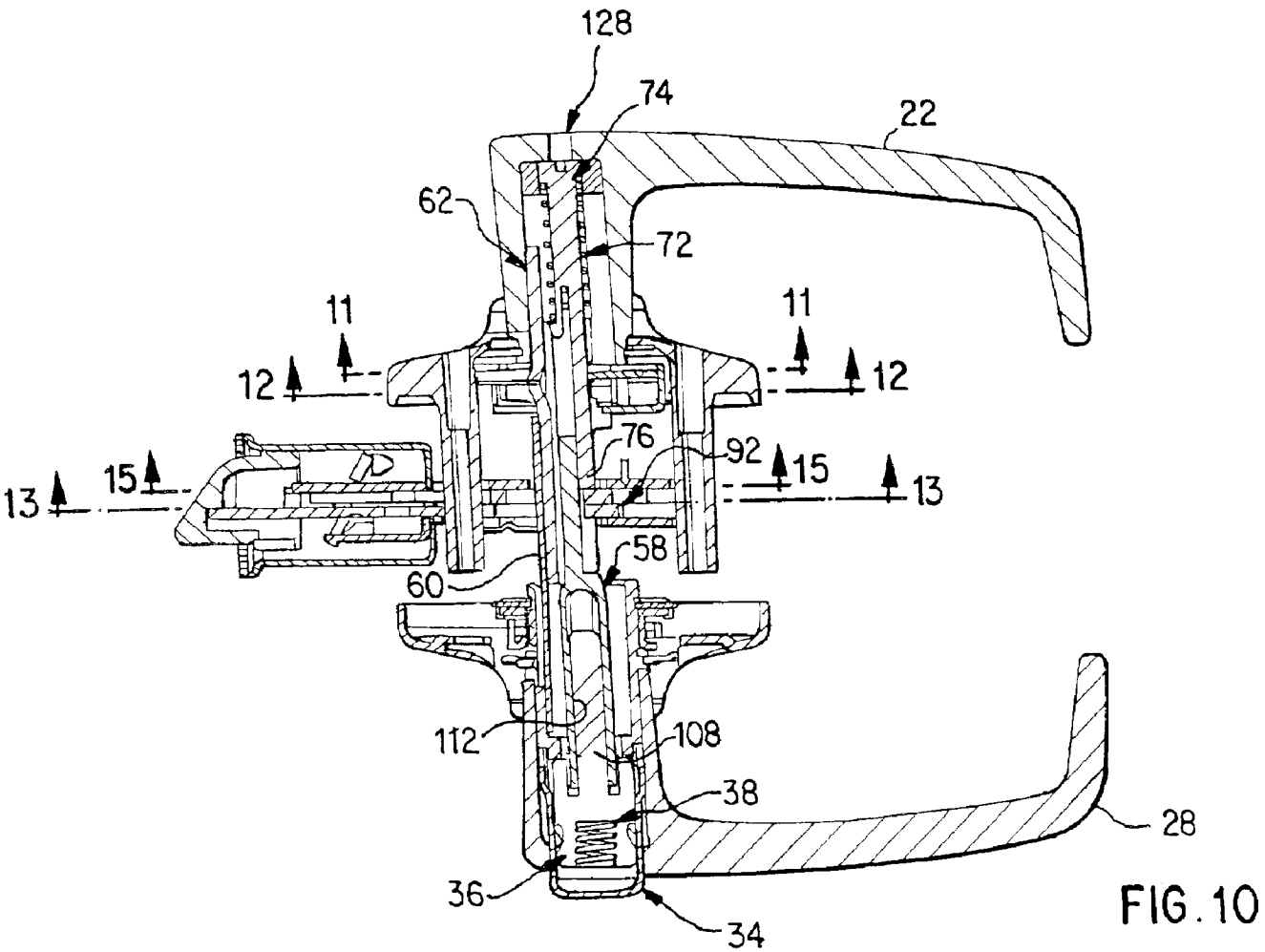
FIG. 10 is a section view taken through the assembled lockset of FIG. 1.

A lever assembly 10 embodying certain aspects of the present invention is illustrated in FIGS. 1 and 10. The lever assembly 10 includes an interior lever assembly 12, an exterior lever assembly 14, a latch assembly 16 and a spindle assembly 18.

As illustrated in FIG. 1, the exterior lever assembly 14 includes an exterior lever 22, a rose liner 24 and a retainer ring 26 that engages the exterior lever 22 to retain the exterior lever 22 on the rose liner 24. As illustrated in FIGS. 1–4, the interior lever assembly 12 includes a lever 28 having an aperture 32, a push button 34 operatively disposed in the aperture 32, a cam 36 disposed in the push button 34, a spring 38 disposed between the push button 34 and the cam 36, an interior insert 42, a retainer ring 44, and a rose liner 46. The interior insert 42 attaches to the lever 28 and the retainer ring 44 engages the interior insert 42 to retain the lever 28 on the rose liner 46. A torsion spring sub-assembly 48 includes a torsion spring 52, a stop plate 54 and a retainer ring 56. The torsion spring sub-assembly 48 fits over the interior insert 42 and is held in place by the retainer ring 56. The stop plate 54 limits the angle of rotation of the lever and prevents the consumer from overstressing the latch assembly 16. An interior half round spindle 60 is press fit into the interior insert 42.

Referring to FIGS. 1–6, the interior lever 28 includes a pair of axially extending slots 94 formed on the inside of the aperture 32. The push button 34 includes a pair of exterior tabs 96 that extend radially outwardly and a pair of interior dimples 98 that extend radially inwardly. The cam 36 includes a cylindrical body 102 with a pair of helical grooves 104 formed in the outer surface thereof, a recess 106 for receiving the spring 38, and a shank 108.

The push button 34 is inserted into the interior lever 28 from the inside so that the exterior tabs 96 engage the slots 94. The tab/slot engagement prevents the push button 34 from rotating relative to the interior lever 28. The spring 38 and cam 36 are inserted into the blind end of the push button 34, with the interior dimples 98 in the push button 34 engaging the helical grooves 104 in the cam 36.

In operation, axial movement of the push button 34 causes the tabs 96 to track axially in the slots 94 and the interior dimples 98 are thereby forced to travel axially as well. However, the dimples 98 are configured to track in the grooves 104 of the cam 36, forcing the cam 36 to rotate inside the push button 34. Thus, axial movement of the push button 34 is translated into rotary motion of the cam 36.

Figure 7:
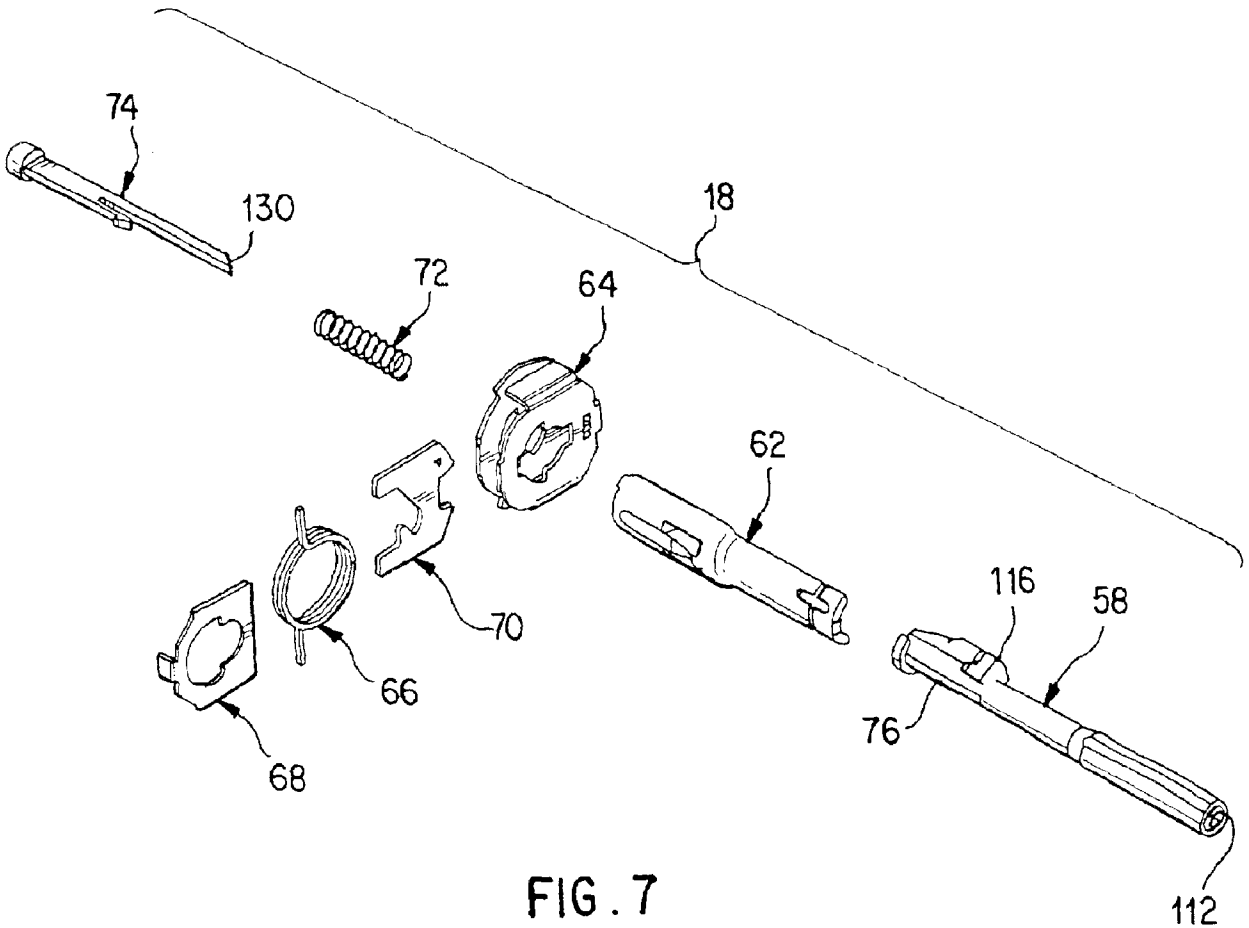
FIG. 7 is an exploded view of a spindle assembly for use with the present invention.

As illustrated in FIGS. 1 and 7, the spindle assembly 18, which is press fitted into the exterior lever 22, includes a full round spindle 58, an exterior half round spindle 62, a locking slide housing 64, a spring 72 and an actuator 74. The locking slide housing 64 contains a torsion spring 66, a detent slide 68, and a locking slide 70. The locking slide 64 is configured to prevent the exterior lever 22 from rotating by engaging one of the posts 25 extending from the rose liner 24, as illustrated in FIG. 10. The actuator 74 provides an emergency release when the lever assembly 10 is locked from the interior side of the door. The spring 72 slides over the actuator 74, as illustrated in FIG. 10, and the actuator 74 extends into a slot 76 formed in the full round spindle 58.

The shank 108 of the cam 36 projects into a conforming axial bore 112 formed in the end of the full round spindle 58 so that rotation of the cam 36 rotates the full round spindle 58 between a locking position and an unlocking position. Accordingly, axial movement of the push button 34 causes rotation of the cam 36 which causes rotation of the full round spindle 58.

Figure 8:
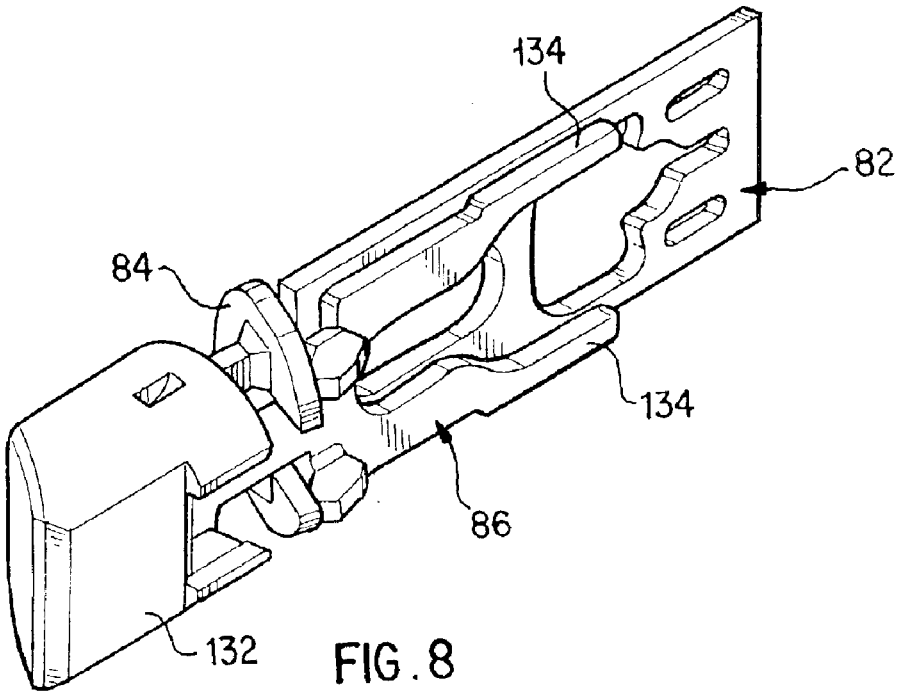
FIG. 8 is a front perspective view of a bolt for use with the present invention.
Figure 9:
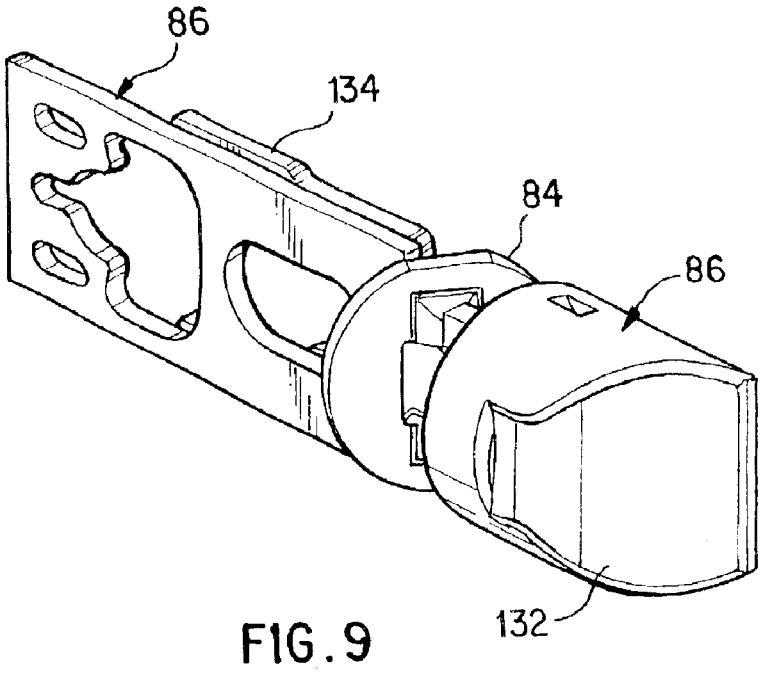
FIG. 9 is a rear perspective view of the bolt of FIG. 8.

The latch assembly 16, illustrated in FIGS. 1 and 8–9, includes a latch case 78 that houses a slide 82, a cam 84, a bolt extension 86, a spring detent 88 and a locking bar 92. The slide 82, the cam 84 and the bolt extension 86 form a sub-assembly as illustrated in FIGS. 8–9.

Figure 13:
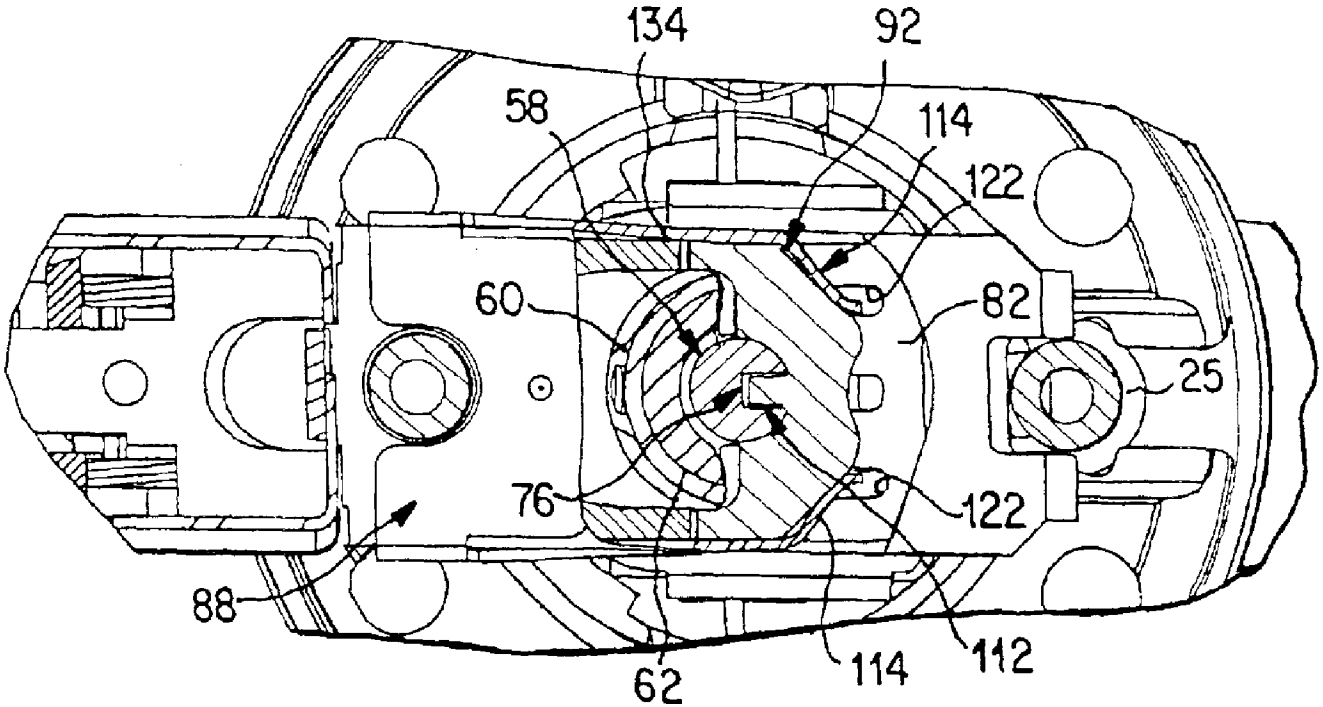
FIG. 13 is a section view taken along line 13—13 in FIG. 10.

As illustrated in FIGS. 10 and 13, the full round spindle 58, the exterior half round spindle 62, and the interior half round spindle 60 extend through the latch case 78 and the slide 82. The half round spindles 58, 60 engage the slide 82 to withdraw the bolt extension 82 into the case 78 in response to movement of the levers 22, 28, respectively. The cam 84 increases the travel ratio of the bolt extension relative to the latch slide 82. The spring detent 88 applies pressure to the locking bar 92 to maintain it in engagement with the full round spindle 58. Operatively, a back plate 90 engages a lip 79 on the latch case 78 and retains the latch case 78 against a front plate 91 and cooperates therewith to secure the latch assembly 16 in a door.

Figure 11:
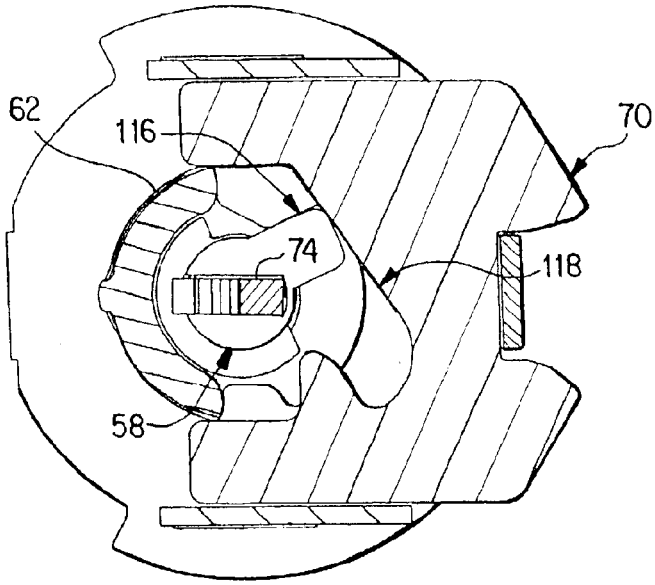
FIG. 11 is a section view taken along line 11—11 in FIG. 10.
Figure 12:
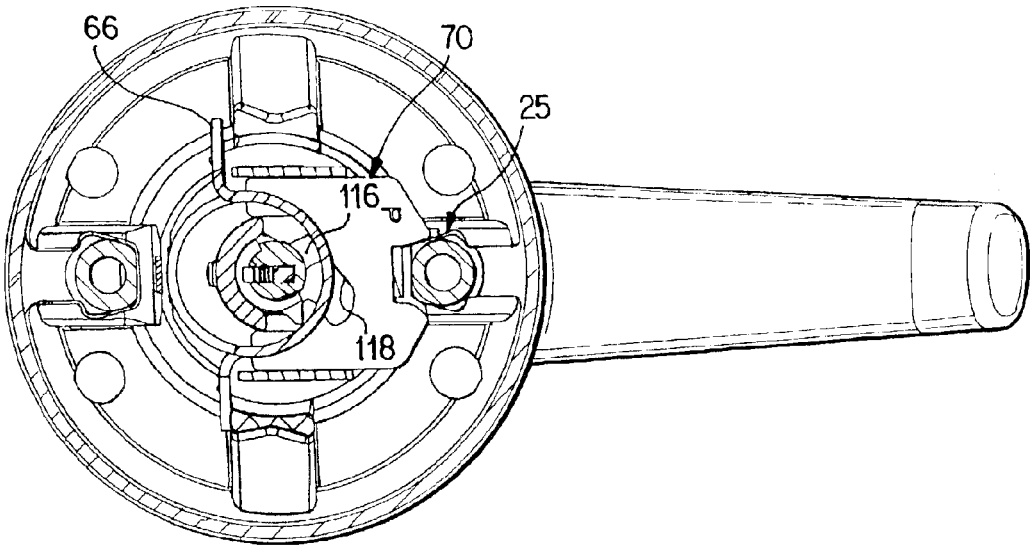
FIG. 12 is a section view taken along line 12—12 in FIG. 10.

To lock the assembly 10, a user pushes the push button 34, which compresses the spring 38 and rotates the cam 36. As the cam 36 rotates, the cam shank 108 turns the full round spindle 58. As the spindle 58 rotates, a rectangular driver 116 formed on the full round spindle 58 engages the locking slide 70 in the locking slide housing 64. As illustrated in FIG. 11, rotation of the full round spindle 58 causes the rectangular driver 116 to engage a camming surface 118. As the rectangular driver 116 moves along the camming surface 118, it urges the locking slide 70 into engagement with one of the posts 25 on the interior rose liner 24, as illustrated in FIG. 12, to lock the lever assembly 10. At the same time, as illustrated in FIG. 13, rotation of the full round spindle 58 moves the slot 76 into position to engage the locking bar 92. The locking bar 92 includes a tongue 112 configured to enter the slot 76 to lock the spindle 58 in position. A pair of resilient fingers 114 formed on the spring detent 88 engages the locking bar 92 to urge the tongue 112 into the slot 76 and retain it in position.

Figure 14:
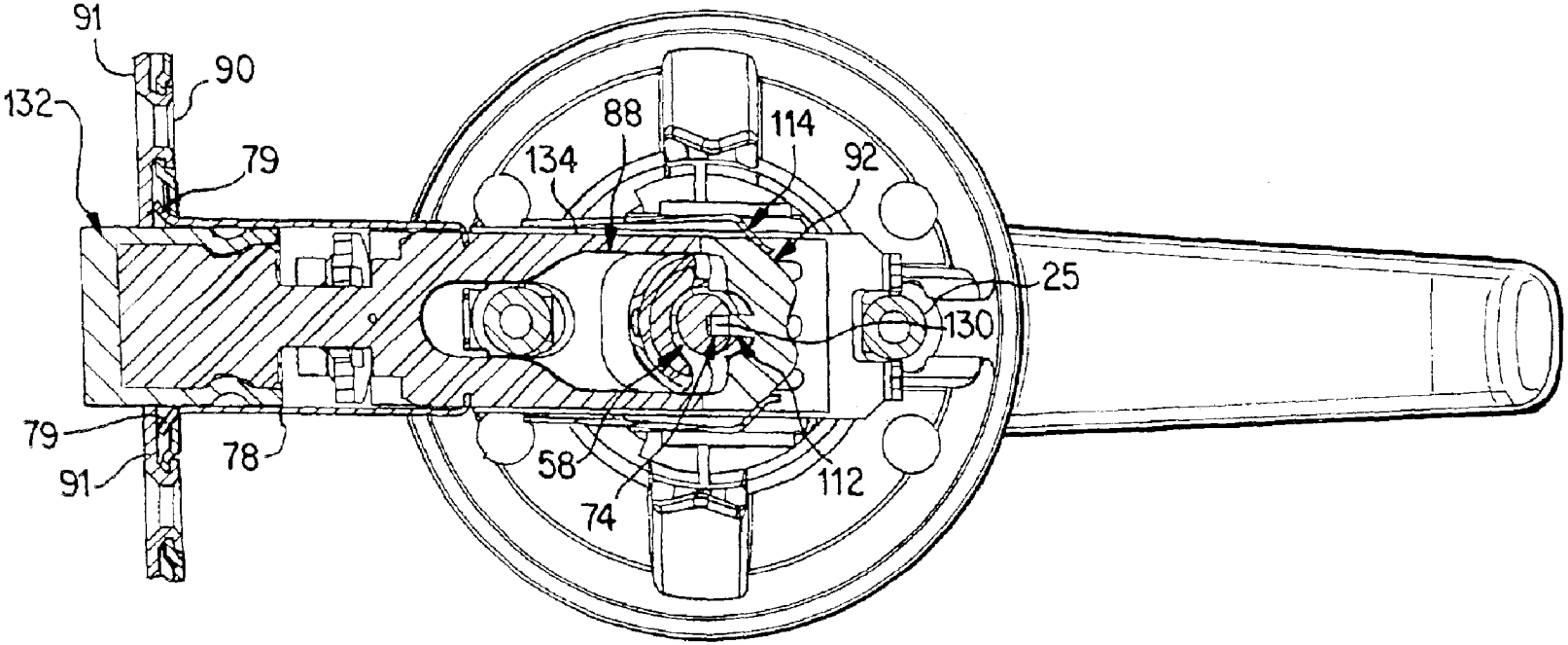
FIG. 14 is a section view taken along line 13—13 in FIG. 10.
Figure 15:
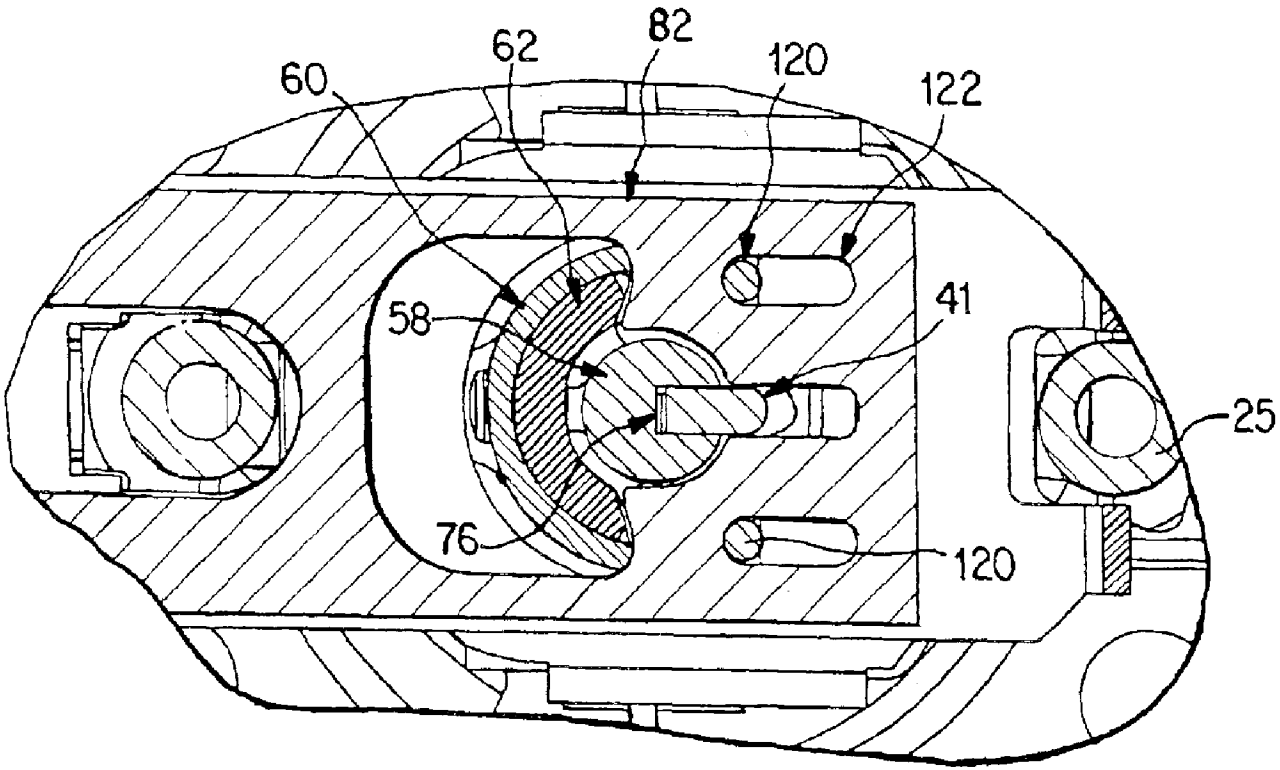
FIG. 15 is a section view taken along line 15—15 in FIG. 10.

One of the features of the lever assembly 10 is the automatic kick-off feature. In the event the door inadvertently closes while the lever assembly 10 is locked, the kick-off feature automatically unlocks the lever assembly 10, ensuring that the user will not be locked out. The bolt extension 86, as best seen in FIGS. 8–9, includes a bolt 132 and a pair of arms 134 that extend from the bolt 132 into the latch case 78. In the assembled lever assembly 10, the arms 134 are spaced slightly apart from the locking bar 92, as illustrated in FIG. 13. As the door closes, the bolt 132 contacts the strike (not shown) and is depressed into the latch case 78. As the bolt 132 is depressed, the arms 132 contact the locking bar 92. Further movement of the bolt 132 moves the locking bar 92 to the right, pushing the tongue 112 out of engagement with the full round spindle 58, as illustrated in FIG. 14. Preferably, about ⅛ inch of travel of the bolt 132 will unlock the lever assembly 10. As the tongue 112 leaves the slot 76, the full round spindle 58 is free to rotate. At the same time, the spring 38 decompresses, thereby pushing the cam 36 axially outwardly. The axially outward movement of the cam 36 causes the cam 36 to rotate, thereby rotating the full round spindle 58. As the full round spindle 58 rotates, the rectangular driver 116 moves along the camming surface 118 of the locking slide 70 to withdraw the locking slide 70 from engagement with the post 25, thereby unlocking the lever assembly 10 and allowing the exterior lever to rotate.

Figure 16:
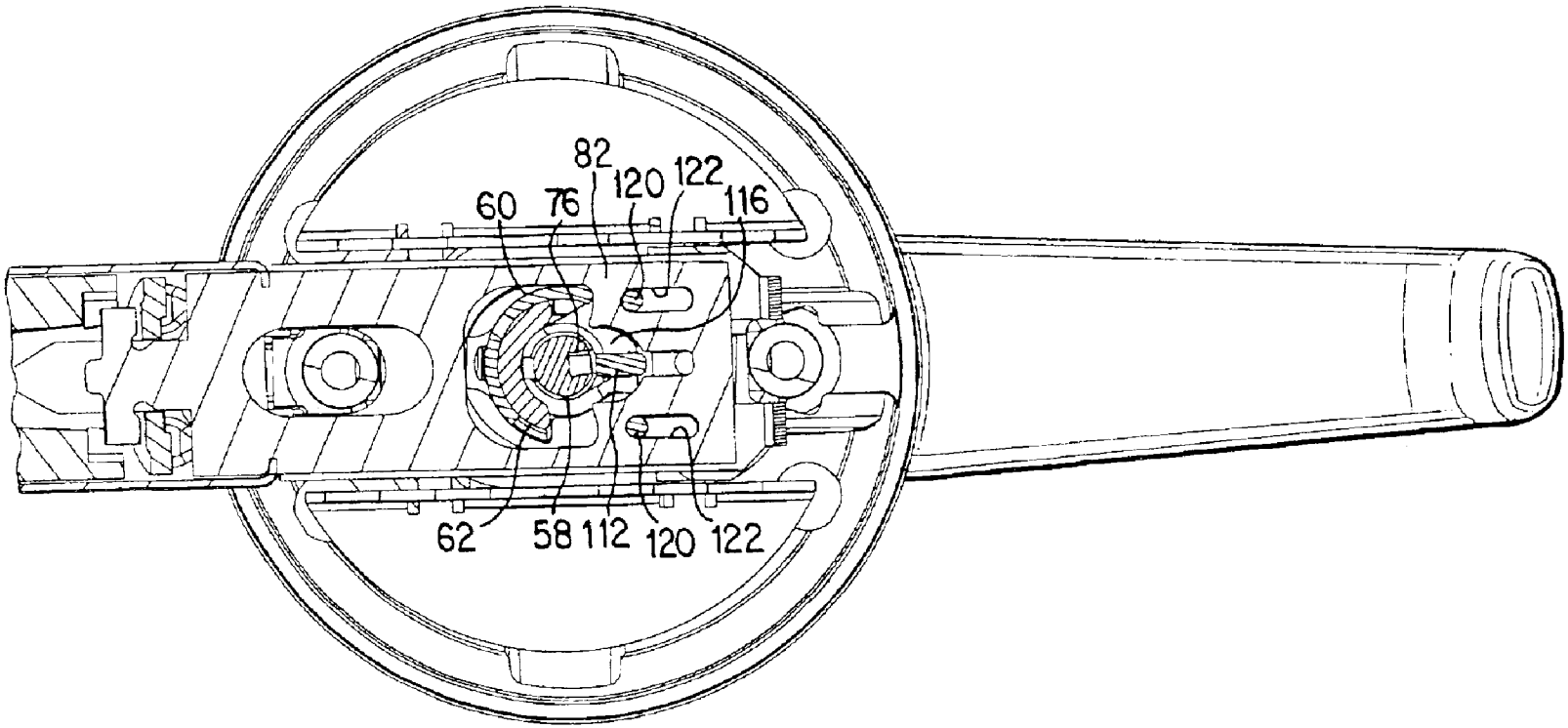
FIG. 16 is a section view taken along line 15—15 in FIG. 10.

A second method of actuating the automatic kick-off feature is to rotate the interior lever 28. Rotation of the interior lever 28 rotates the interior half round spindle 60. In the locked condition, the tongue 112 is still engaged with the slot 76. However, rotation of the lever 28 causes the interior half round spindle 60 to engage the locking bar 92, moving it to the right as viewed in FIG. 16. A pair of upstanding bosses 120 formed on the locking bar 92 travel in a pair of slots 122 formed in the slide 82. Thus, the locking bar 92 can move the length of the slots 122 without retracting the bolt 86. Pushing the locking bar 92 to the right moves the tongue 112 out of the slot 76. At the same time, the resilient fingers 114 on the spring detent 88 move upwardly to the flat upper and lower surfaces 124, 126 on the locking bar 92 (FIG. 14), permitting the locking bar 92 to remain in position.

Another feature of the lever assembly 10 is the emergency release capability, embodied in the actuator 74. The actuator 74 is disposed in the slot 76 in the full round spindle 58. In the locked condition, the tongue 112 of the locking bar 92 is likewise disposed in the slot 76. A user actuates the emergency release by inserting a slender object, such as a nail, through a hole 128 formed in the exterior lever 22 and pushing against the actuator 74. The actuator 74 includes a distal end having a beveled surface 130, as illustrated in FIGS. 7 and 10. As the actuator 74 moves in the slot 76, the beveled surface 130 cams the tongue 112 out of the slot 76, allowing the spindle assembly 18 to rotate. When the tongue 112 clears the slot 76, the spring 38 decompresses, pushing the cam 36 axially outwardly. The axially outward movement of the cam 36 causes the cam 36 to rotate, thereby rotating the full round spindle 58. As the full round spindle 58 rotates, the slot 76 is rotated out of position for engagement with the tongue 112. At the same time, the rectangular driver 116 of the full round spindle 58 moves along the camming surface 118 of the locking slide 70 to withdraw the locking slide 70 from engagement with the post 25, thereby unlocking the lever assembly 10. With the lever assembly 10 unlocked, the interior half round 60 or exterior half round spindle 62 moves with the interior or exterior lever 22, 28, respectively, to engage the slide 82. As the half round 60, 62 continues to rotate, it moves the slide 82 to the right, as viewed in the drawings, thereby withdrawing the bolt 132 into the latch case 82 and unlatching the door.

The above-described embodiments, of course, are not to be construed as limiting the breadth of the present invention. Modifications and other alternative constructions will be apparent which are within the spirit and scope of the invention as defined in the appended claims.

What is claimed is:

1. A tubular lock assembly having a tubular chassis comprising:

an exterior assembly;

an interior assembly having a push button locking mechanism;

a spindle assembly coupled to the exterior assembly and the interior assembly and including an actuator;

a latch assembly coupled to the spindle assembly including a locking member movable between a locking position and an unlocking position, a biasing member detent configured to bias the locking member in the locking position, an actuator, a bolt configured to engage the locking member and move the locking member from the locking position to the unlocking position, the locking member being movable to the unlocking position, independent of movement of the bolt, in response to movement of the interior assembly, the locking member being movable to the unlocking position, independent of movement of the bolt, in response to movement of the actuator, wherein the spindle assembly includes a full round spindle, the locking member including means for engaging the full round spindle to prevent movement of the exterior assembly.

2. A tubular lock assembly having a tubular chassis comprising:

an exterior assembly;

an interior assembly having a push button locking mechanism;

a spindle assembly coupled to the exterior assembly and the interior assembly and including an actuator;

a latch assembly coupled to the spindle assembly including a locking member movable between a locking position and an unlocking position, a biasing member detent configured to bias the locking member in the locking position, an actuator, a bolt configured to engage the locking member and move the locking member from the locking position to the unlocking position, the locking member being movable to the unlocking position, independent of movement of the bolt, in response to movement of the interior assembly, the locking member being movable to the unlocking position, independent of movement of the bolt, in response to movement of the actuator, wherein the interior assembly includes a half round configured to engage the locking member and move the locking member to the unlocking position.

3. A tubular lock assembly having a tubular chassis comprising:

an exterior assembly mounted on an outside surface of a door;

an interior assembly mounted on an inside surface of the door and having a rotating handle and a push button locking mechanism;

a spindle assembly coupled to the exterior assembly and the interior assembly; and a latch assembly coupled to the spindle assembly including locking means for moving between a locking position and an unlocking position, resilient means for retaining the locking means in the locking position, and first means for moving the locking means from the locking position to the unlocking position, independent of movement of either the interior assembly or the exterior assembly;

second means, coupled to the exterior assembly, for moving the locking means from the locking position to the unlocking position, independent of movement of either the interior assembly or the first means for moving; and third means, coupled to the interior assembly, for moving the locking means from the locking position to the unlocking position in response to rotation of the interior assembly, independent of movement of either the exterior assembly or the bolt means for moving.

4. A tubular lock assembly having a tubular chassis comprising:

an exterior assembly mounted on an outside surface of a door;

an interior assembly mounted on an inside surface of the door and having a push button locking mechanism;

a spindle assembly coupled to the exterior assembly and the interior assembly; and a latch assembly coupled to the spindle assembly including locking means for moving between a locking position and an unlocking position, resilient means for retaining the locking means in the locking position, and first means for moving the locking means from the locking position to the unlocking position, independent of movement of either the interior assembly or the exterior assembly;

second means, coupled to the exterior assembly, for moving the locking means from the locking position to the unlocking position, independent of movement of either the interior assembly or the first means for moving; and third means, coupled to the interior assembly, for moving the locking means from the locking position to the unlocking position in response to movement of the interior assembly, independent of movement of either the exterior assembly or the bolt means for moving, wherein the spindle assembly includes a spindle having a slot and the locking means includes a locking member having a tongue configured to engage the slot to lock the tubular lock assembly and the first means for moving includes a bolt disposed in the latch assembly to engage the locking member to move the tongue out of the slot.

5. The assembly of claim 4 wherein the second means for moving includes an actuator disposed in the slot and configured to cam the locking member out of the slot.

6. The assembly of claim 4 wherein the third means for moving includes a half round coupled to the interior assembly, the half round being disposed to engage the locking member to move the tongue out of the slot in response to movement of the interior assembly.

7. A tubular lock assembly having a tubular chassis comprising:

an interior assembly having an interior operator and a push button locking mechanism;

an exterior assembly having an exterior operator;

a spindle assembly coupled to the exterior assembly and having a spindle and a locking slide, the spindle having means for moving the locking slide and a longitudinally extending slot, the spindle rotating in response to movement of the push button locking mechanism between a spindle locking position and a spindle unlocking position, the locking slide being moveable from an unlocking position to a locking position in response to rotation of the spindle from the spindle unlocking position to the spindle locking position; and a bolt assembly coupled to the spindle assembly and including a bolt and a locking member, the locking member being configured to engage the slot to prevent rotation of the spindle from the spindle locking position to the spindle unlocking position, the bolt being movable between a latching position and an unlatching position in response to movement of one of the interior operator and the exterior operator.

8. The assembly of claim 7 further including first means coupled to the exterior operator for moving the locking member out of engagement with the slot.

9. The assembly of claim 7 further including second means coupled to the interior operator for moving the locking member out of engagement with the slot.

10. The assembly of claim 7 further including third means coupled to the bolt for moving the locking member from the locking position to the unlocking position.

11. A tubular lock assembly having a locked condition and an unlocked condition, the assembly comprising:

an interior assembly;

an exterior assembly;

a spindle assembly coupled to the interior assembly and the exterior assembly and having a spindle, a locking slide and a locking bar, the locking slide being moveable between a first position in the unlocked condition and a second position in the locked condition and the locking bar being moveable between a first position in the unlocked condition to a second position in the locked condition;

a push button locking mechanism coupled to the spindle, the push button locking mechanism being moveable between a first position in the unlocked condition and a second position in the locked condition, the spindle moving to the second position in response to movement of the push button lock mechanism to the second position, the locking slide moving to the second position in response to movement of the spindle to the second position, and the locking bar moving to the second position in response to movement of the spindle to the second position; and a bolt coupled to the locking bar, the locking bar moving from the second position to the first position in response to movement of the bolt.

* * * * *